US009540579B2

(12) United States Patent
Gorodetsky et al.

(10) Patent No.: US 9,540,579 B2
(45) Date of Patent: Jan. 10, 2017

(54) PROCESS FOR PRODUCING SYNGAS USING PLASMA GASIFIERS

(71) Applicant: Alter NRG Corp., Calgary (CA)

(72) Inventors: Aleksandr Gorodetsky, Calgary (CA); James Santoianni, Greensburg, PA (US); Surendra Chavda, Calgary (CA); Sureshkumar Kukadiya, Calgary (CA)

(73) Assignee: Alter NRG Corp., Calgary, Alberta (CA)

( * ) Notice: Subject to any disclaimer, the term of this patent is extended or adjusted under 35 U.S.C. 154(b) by 192 days.

(21) Appl. No.: 14/631,214

(22) Filed: Feb. 25, 2015

(65) Prior Publication Data

US 2015/0166914 A1 Jun. 18, 2015

Related U.S. Application Data

(62) Division of application No. 13/199,813, filed on Sep. 9, 2011, now Pat. No. 9,005,320.

(51) Int. Cl.

| | |
|---|---|
| ***C01B 7/00*** | (2006.01) |
| ***C10L 3/10*** | (2006.01) |
| ***C10J 3/18*** | (2006.01) |
| ***C10J 3/84*** | (2006.01) |

(52) U.S. Cl.

CPC .. *C10L 3/10* (2013.01); *C10J 3/18* (2013.01); *C10J 3/84* (2013.01); *C10J 2300/1238* (2013.01)

(58) Field of Classification Search

CPC ..... F23G 5/24

See application file for complete search history.

(56) References Cited

U.S. PATENT DOCUMENTS

| | | | |
|---|---|---|---|
| 2,627,455 | A | 2/1953 | Berg |
| 2,875,137 | A | 2/1959 | Lieffers et al. |
| 3,217,056 | A | 11/1965 | Sennewald et al. |
| 3,476,650 | A | 11/1969 | Peacock |
| 3,602,362 | A | 8/1971 | Jacobson |
| 4,129,422 | A | 12/1978 | Wood |
| 4,197,092 | A | 4/1980 | Bretz |

(Continued)

FOREIGN PATENT DOCUMENTS

| | | |
|---|---|---|
| DE | 3439404 A1 | 5/1985 |
| DE | 4417082 C1 | 10/1995 |

(Continued)

*Primary Examiner* — Imran Akram

(74) *Attorney, Agent, or Firm* — Alan G. Towner, Esq.; Pietragallo Gordon Alfano Bosick & Raspanti, LLP

(57) ABSTRACT

A process for gasification of solid feed material to produce a syngas includes: providing a plasma heated carbonaceous bed in a bottom section of a reactor vessel; forming a bed of deposited feed material on top of the carbonaceous bed; reacting the feed material with hot gases rising from the bottom section; forming, in a middle section of the reactor vessel, a syngas mixture containing a varying quantity of unreacted particles of the feed material; allowing the syngas mixture to rise into a top section of the reactor vessel; and at least partially quenching, by injecting a quench fluid including water, steam, or a mixture thereof, in a second, upper part of the top section, at least some of the unreacted particles sufficiently to reduce the number of unreacted particles exiting the reactor vessel that are likely to be deposited on walls of external ductwork.

21 Claims, 3 Drawing Sheets

(56) References Cited

U.S. PATENT DOCUMENTS

| | | | | |
|---|---|---|---|---|
| 4,200,438 | A | 4/1980 | Kaimann et al. | |
| 4,761,793 | A | 8/1988 | Digne et al. | |
| 4,998,486 | A | 3/1991 | Dighe et al. | |
| 5,544,597 | A | 8/1996 | Camacho | |
| 5,634,414 | A | 6/1997 | Camacho | |
| 5,728,193 | A | 3/1998 | Dighe et al. | |
| 6,719,952 | B1 | 4/2004 | Yang et al. | |
| 6,987,792 | B2 | 1/2006 | Do et al. | |
| 7,632,394 | B2 | 12/2009 | Dighe et al. | |
| 2004/0170210 | A1 | 9/2004 | Do et al. | |
| 2006/0086698 | A1 | 4/2006 | Jackson | |
| 2006/0112639 | A1 | 6/2006 | Nick et al. | |
| 2007/0266634 | A1 | 11/2007 | Tsangaris et al. | |
| 2008/0041572 | A1* | 2/2008 | Wessel | C10J 3/485 165/157 |
| 2008/0148634 | A1 | 6/2008 | Yu et al. | |
| 2008/0202028 | A1 | 8/2008 | Tsangaris et al. | |
| 2008/0222956 | A1 | 9/2008 | Tsangaris et al. | |
| 2008/0299019 | A1 | 12/2008 | Dighe et al. | |
| 2009/0064581 | A1 | 3/2009 | Nielsen et al. | |
| 2009/0307974 | A1 | 12/2009 | Dighe et al. | |
| 2010/0146857 | A1* | 6/2010 | Zamansky | C10J 3/466 48/197 FM |
| 2010/0199557 | A1 | 8/2010 | Dighe et al. | |
| 2010/0219062 | A1* | 9/2010 | Leon Sanchez | C10J 3/466 204/157.43 |
| 2012/0121477 | A1* | 5/2012 | Ali | F23G 5/0276 422/184.1 |
| 2013/0300121 | A1* | 11/2013 | Ali | F23G 5/0276 290/52 |

FOREIGN PATENT DOCUMENTS

| | | | |
|---|---|---|---|
| EP | 1489046 | A1 | 12/2004 |
| WO | 2010093553 | A2 | 8/2010 |

* cited by examiner

PROCESS FOR PRODUCING SYNGAS USING PLASMA GASIFIERS

CROSS-REFERENCE TO RELATED APPLICATIONS

This application is a divisional application of U.S. patent application Ser. No. 13/199,813, filed Sep. 9, 2011, and titled "Enhanced Plasma Gasifiers For Producing Syngas", which claims the benefit of U.S. Provisional Application No. 61/462,601, filed Feb. 5, 2011. These applications are hereby incorporated by reference.

A companion application (U.S. patent application Ser. No. 13/199,814, filed Sep. 9, 2011, entitled "Plasma Gasification Reactors with Modified Carbon Beds and Reduced Coke Requirements", US Patent Application Publication No. 2012/0061618) filed on the same date as the U.S. patent application Ser. No. 13/199,813, includes descriptions related to plasma gasifiers and their operation that may be combined with the subject matter of U.S. patent application Ser. No. 13/199,813, and said companion application is hereby incorporated by reference for such descriptions.

FIELD OF THE INVENTION

The invention relates to processes that can be performed in plasma gasifiers (sometimes referred to herein as PGs and which may also be referred to as plasma gasification reactors or PGRs).

BACKGROUND

Extensive literature, both in patents and otherwise, deals with construction and operation of a plasma gasifier to process a feed material of various kinds, including, for example, waste materials such as municipal solid waste (MSW), to produce a synthesis gas, or syngas. Such technology can be of major benefit both in terms of waste disposal and, also, conversion of the disposed waste to form syngas for use as a fuel.

Some examples of techniques for such purposes are contained, or referred to, in US published patent application 20100199557, Aug. 12, 2010, by Dighe et al., assigned to Alter Nrg Corp., and in "Industrial Plasma Torch Systems", Westinghouse Plasma Corporation, Descriptive Bulletin 27-501, published in or by 2005, and all such descriptions are incorporated by reference herein.

In the present description "plasma gasifier reactor" and "PGR" are intended to refer to reactors of the same general type whether applied for gasification or vitrification, or both. Unless the context indicates otherwise, terms such as "gasifier" or "gasification" used herein can be understood to apply alternatively or additionally to "vitrifier" or "vitrification", and vice versa.

Prior practices have a degree of successful operation that is continually desirable to improve upon.

SUMMARY

In a described embodiment, a process for gasification of solid feed material to produce a syngas includes: providing a plasma heated carbonaceous bed in a bottom section of a reactor vessel; feeding feed material into the reactor vessel to form a bed of deposited feed material on top of the carbonaceous bed in the bottom section; reacting the feed material with hot gases rising from the bottom section; forming, in a middle section of the reactor vessel, a syngas mixture containing a varying quantity of unreacted particles of the feed material; allowing the syngas mixture to rise into a top section of the reactor vessel toward one or more syngas outlets; maintaining conditions in the vessel such that unreacted particles from the middle section are subjected to further reactions in a first, lower, part of the top section; and at least partially quenching, by injecting a quench fluid including water, steam, or a mixture thereof, in a second, upper part of the top section, at least some of the unreacted particles sufficiently to reduce the number of unreacted particles exiting the reactor vessel that are likely to be deposited on walls of external ductwork.

DETAILED DESCRIPTION

Figure 1:
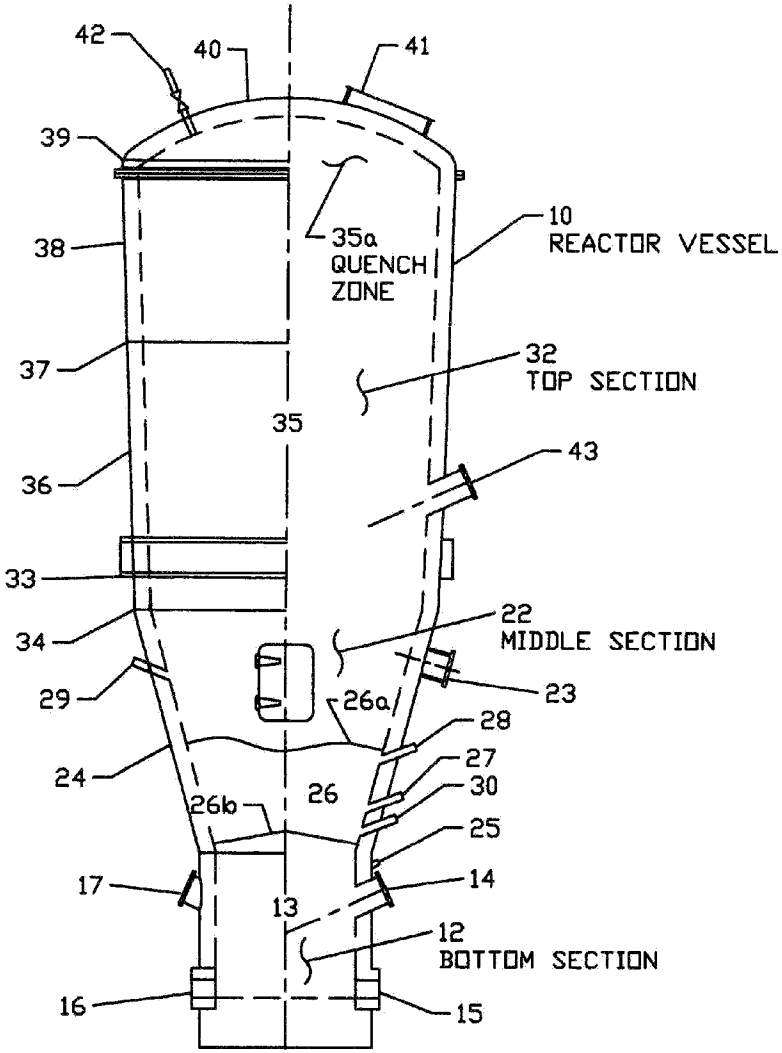
FIGS. 1 and 2 are, respectively, an elevation view and a top plan view of an example of a plasma gasifier.
Figure 2:
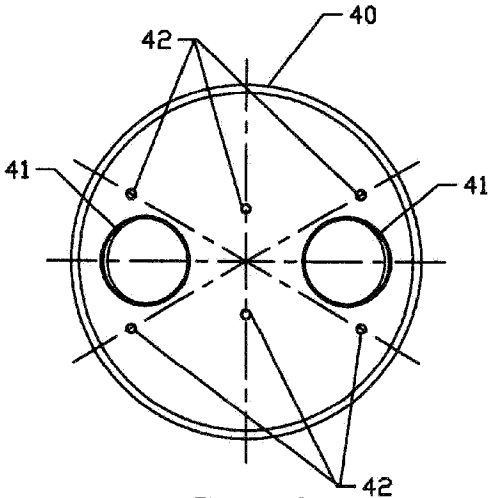

FIGS. 1 and 2 show one example of a plasma gasifier that has both a syngas quench system and feed ports introducing feed material into a middle section of the gasifier reactor vessel.

The gasifier example of FIGS. 1 and 2 includes a refractory-lined reactor vessel 10 having three principal sections that, from bottom to top, are a bottom section 12, a middle section 22, and a top section 32.

The bottom section 12 contains a carbonaceous bed 13, one or more plasma torch tuyeres 14, a slag and molten metal tap hole 15 (there may be multiple tap holes), a lower start-up burner port (also serves as an emergency tap hole) 16, and one or more carbon bed tuyeres 17.

The carbonaceous bed 13 (sometimes referred to as the C bed) of the bottom section may be of metallurgical coke or other carbonaceous material derived from fossil fuel or from non-fossil sources (e.g., from biomass in various forms such as disclosed in the above-mentioned companion application). The plasma torch tuyeres 14 and the C bed tuyeres 17 in this example may each be six in number; they are arranged symmetrically about the bottom section's cylindrical wall 18, are angled down about 15% from horizontal and are aimed centrally into the C bed 13. The plasma torch tuyeres 14 are for plasma injection into the C bed 13. The C bed tuyeres 17 are additionally provided for optional use to introduce gas, such as air or oxygen, into the C bed 13. The lower burner port 16 can be used for heating, by a natural gas (or other fuel) burner, the refractory material along the wall of the reactor vessel to provide an internal vessel temperature above the autoignition temperature of combustibles such as carbon, hydrogen, CO and syngas introduced into the vessel. Then the supply of plasma, feed material and other reactants may occur with more safety and less risk of explosion.

The middle section 22 has one or more (such as three) feed ports 23 through the middle section's conical, upwardly expanding (helpful for more constant gas velocity) wall 24. The cylindrical wall 18 of the bottom section 12 and the middle section 14 conical wall 24 are joined at a detachable bottom flange joint 25. The feed ports 23 are angled up from horizontal by about 15° which helps minimize entry of moisture from wet feed material and can be favorable in other respects as described below. Horizontal or downward directed feed ports can also be acceptable in some embodiments. Feed material is supplied through the feed ports 23 from external feed supplies via mechanisms (not shown here) that desirably help achieve a substantially uniform and continuous feed rate, such as a compacting screw feeder which may be of a known commercial type. The introduced feed material forms a feed bed 26 in the middle section 22 above the C bed 13 of the bottom section 12. The middle section 22 also has a number (e.g., 12 to 24 each) of lower feed bed tuyeres 27 and upper feed bed tuyeres 28 that can be used to inject gases directly into the feed bed 26 as well as one or more gas space tuyeres 29 above the feed bed 26. Additionally shown in this example are a sight glass 30 for viewing within the feed bed 26 and an access door for personnel entry when the vessel (out of operation) needs internal inspection or maintenance.

The feed bed 26 is shown with upper and lower surface lines 26*a* and 26*b*, respectively, which are merely representative of the extent of the feed bed 26. In this example, the rate of supply of feed material and the rate of consumption of feed material in the feed bed 26 are regulated to an extent to keep the upper surface 26*a* below the feed ports 23 so the feed bed 26 does not interfere with the entry of feed material. (There may be provided feed bed level sensors as well as visual access to confirm no blockage occurs.) Otherwise, the feed ports 23 and the feed bed upper surface 26*a* are desirably proximate each other which promotes a longer residence time within the vessel 10 for particulates within the feed material that may be so light they do not descend onto the feed bed 26. A longer residence time in the vessel will enhance the probability of gasification of such particles in the middle section 22 above the feed bed 26 and in the top section 32. Heavier segments of the feed material fall immediately to form and to be reacted (gasified) in the feed bed 26. In general, in embodiments with middle section feed ports, the feed ports and the upper surface of the feed bed are desirably "proximate", or close to, each other in the vertical direction as much as reasonably possible without encountering problems of feed port blockage or material in feed ports seeing radiation heating from the feed bed. The angling up of the feed ports in this example assists in the latter purpose). The middle section 22 may sometimes be referred to as having a lower part containing the feed bed 26 and an upper part with one or more feed ports 23 while still recognizing they are proximate to each other. This arrangement provides a greater distance between the feed ports and gas outlets, described below. Maximizing that distance can be favorable for gasification of fine particulates introduced in the feed material which may be of any of a wide variety of materials. For producing a syngas for use as a fuel, or fuel source, the feed material desirably includes some hydrocarbons; examples are MSW as well as biomass of various forms (and any mixtures thereof) that may include a large amount of fines that are better gasified by having a longer residence time for the reactor.

Still other embodiments, discussed below with reference to FIGS. 5-8, have feed ports that supply feed material directly into the feed bed.

Returning to FIGS. 1 and 2, the top section 32 of the reactor vessel is supported within a fixed support 33 and is joined with the middle section 22 at the line 34. As illustrated, the top section 32 is within an upper shell of the reactor vessel 10 and the middle section 22 is within a lower shell of the reactor vessel. The volume within the top section 32 is vertically large (e.g., at least about equal to the vertical extent of both the bottom and middle sections 12 and 22 together) for further gasification reactions within a freeboard region 35 and for an upper quench zone 35*a*. The top section 32, in this example, has a first part adjacent the middle section 22 that has an upwardly enlarging conical wall 36 (with less angle than the angle of the wall 24 of the middle section 22) that is joined at line 37 with a second part that has a cylindrical wall 38, above which, starting at line or lateral support 39, the top section 32 has a rounded, or domed, roof 40.

The illustrated configuration of wall parts 36 and 38 of the top section 32 facilitates construction of the vessel 10. In general, it is not necessary to vary the wall angle of the top section. For example, its entire extent could be substantially entirely conical. As explained in the above-mentioned published patent application, an expanding conical side wall can be favorable for maintaining gas flow at desirable levels. An expanding conical section reduces the gas velocity so it has a longer residence time; and it aids in having particulates settle out. The reactors of FIGS. 1 and 2 include a top section quench system, and whatever the wall shape is, there is provided added volume within the top section 32 for the quench zone 35*a*. That is, the freeboard region 35 is desirably sized and shaped for further gasification of material rising with hot gas from the feed bed 26. Gasification can be substantially complete in the freeboard region 35 to the extent that at the level 37 a product syngas can exist that would typically in the past be immediately exhausted from a reactor vessel that could be substantially like the vessel 10 in other respects but have no quench zone (such as the zone 35*a*) above the freeboard region; instead, in the past, a roof would be located at the immediate top of the freeboard region and an exhaust port or ports would be through the roof on an upper part of the lateral wall of the freeboard region. As discussed below, there are instances in which some further gasification may occur in the quench zone 35*a* that can contribute to the quality of the output syngas.

The volume within the top section 32 designated the quench zone 35*a* is the volume of the top section penetrated by and affected by quench fluid while the volume below is here referred to as the freeboard region. For present purposes, the freeboard zone 35 and the quench zone 35*a* are generally regarded as two zones one above the other. Terminology applying the term "freeboard" to the total top section volume, but having a quench zone within the upper part of the freeboard is also applicable. In either case, the quench zone is an additional volume to that of otherwise similar prior reactors.

In the FIG. 1 embodiment, the roof 40 of the top section 32 has one or more (here two as shown in FIG. 2) syngas outlets 41 and a plurality of quench fluid inlets 42 symmetrically arranged over the roof 40. Variations may include only a single quench nozzle for injecting fluid into the quench zone, although an arrangement of a plurality of quench nozzles, particularly an array that is symmetrical in relation to the outlets, is usually preferred for more effective quenching. (In general, unless the context indicates otherwise, any mention in this application of feed ports, quench nozzles, or gas outlets means any one or more of such elements.)

The quench fluid inlets 42 are six in number in this example and make up a syngas quench system effective within the quench zone 35*a* in the upper part of the top section above the freeboard region 35. The quench zone 35*a* can be considered to be within about the top one-third of the top section 32 and is a region in which fluid (such as water, steam or a mix of water and steam, or possibly recycled syngas or an inert gas such as nitrogen) introduced through the inlets 42 provides an atomized mist that lowers the temperature in the quench zone 35*a* to make particulates rising with syngas into the quench zone less likely to exit through the outlets 41 in a molten (or soft) state and attach to, or condense on, the interior of external ductwork (not shown) from the outlets 41.

The quench zone 35*a*, where quenching by the inlets 42 occurs, is constructed with a volume to accommodate the injected fluid, which will thermally expand in the vessel, so as not to significantly affect the progress of syngas from the freeboard region 35 to the outlets 41. Some additional gasification may occur in the quench zone 35*a* but its added volume is primarily for the partial quenching function, as further described in FIGS. 3 and 4. In many instances, it will be preferable that the quench system fluids, as to their temperature and quantity, are limited to only cooling the rising syngas and particulate mixture merely enough to partially quench the softer or molten particulates so they become more solid and not "sticky" to an exhaust duct surface. It is not generally desirable to cause any large drop in temperature in the quench zone as a larger temperature drop in the quench zone may have an adverse thermal effect lower in the reactor vessel. An additional effect of the quench nozzles and the quench zone is that the injected fluid (e.g., water) can make some particulates agglomerate in the quench zone and to form larger particles that fall back down into the freeboard region, and possibly to the feed bed, rather than be exhausted through the outlets. This can be desirable to reduce operating cost and capital cost for equipment downstream from the outlets. These aspects of the quench system and quench zone are further discussed below.

The top section 32 also has an upper start-up burner port 43 for use as described for the lower start-up burner port 16. Use of the two start-up burner ports 16 and 43 provides more uniform heating of the interior of the vessel with combustible gases eliminated before plasma pyrolysis commences.

By way of further example, the gasifier embodiment of FIGS. 1 and 2 is shown substantially to scale. As one example, it may be of an overall height of about 22.5 m and maximum width of about 9 m, but a wide variance of reactor dimensions can be suitable for reactors incorporating the present innovations. As one example, the angles of the conical walls 24 and 36 are about 20° and 5°, respectively, from the vertical axis. The size and configuration may be varied considerably from that shown in this example.

Among other variations, (using reference numbers like the corresponding elements of FIGS. 1 and 2) a gasifier with a quench zone 35*a* and quench fluid inlets 42 such as described above may be provided with a vessel of any wall configuration. Also, such a quench system may be provided in a gasifier with other material feed ports, e.g., one or more feed ports into the top section; or there may be one or more feed ports in each of both the middle and top sections. Benefits attainable with the quench system do not require having both a quench system and middle section feed ports.

The quench system of quench zone 35*a* and inlets 42 may, for example, do a partial quench such as reducing the temperature of the syngas mixture that rises in the freeboard region at about 1000 to 1150° C. down to about 850° C. at the outlets 41 which can minimize sticking of molten or soft particles on the interior of ductwork from the outlets 41. Typical examples of suitable quenching are those that reduce the temperature of molten particulates rising from the freeboard region 35 by about 150 to 300° C. before they reach the outlets 41. Also, see the discussion below regarding FIGS. 3 and 4 for a further description of some aspects on the top section quench zone and how it may operate.

In embodiments with middle section feed ports 23 proximate the feed bed 26, it is not always required to have quench fluid inlets into a quench zone above a freeboard region. That is, advantage of the middle section feed ports can be taken even without the quench system. For example, quenching means may not be present or may occur only in the external ductwork from the syngas outlets. As disclosed in the above-mentioned companion patent application, an arrangement of feed ports proximate the feed bed can be favorable for minimizing carbon consumption in the C bed and that applies with or without a quench system or any particular form of quench system.

Additional points, for example, are that the feed material may, in addition to waste, such as MSW, to be processed, include, or be accompanied by, additional carbonaceous material (which may be retained and consumed in the feed bed or which may descend through the feed bed into the C bed 13 of the bottom section), and, also, flux to adjust the basicity, viscosity, and melting temperature of slag that forms and descends to the tap hole 15 in the bottom section. Also, any particulates that are carried out of the reactor with the outlet syngas may be captured externally and fed back in with the feed material.

The plasma torch tuyeres are provided with plasma torches of which an example is that commercially available as the MARC-11L™ plasma torch from Westinghouse Plasma Corporation. Such torches use a shroud gas in addition to a torch gas and oxygen or air may be used for those purposes, as well as other gases (see Dighe et al. U.S. Pat. No. 4,761,793 which is incorporated by reference herein for descriptions of plasma torch arrangements). The gas introduced by the torch can be superheated to a temperature in excess of 10,000° F. (about 5500° C.) that greatly exceeds conventional combustion temperatures.

The plasma torch tuyeres are sometimes referred to as primary tuyeres. The lower and upper tuyeres 27 and 28 of the middle section 22 are sometimes referred to as secondary and tertiary tuyeres, respectively. The tuyeres 27 and 28 can be used to deliver oxygen to further help control syngas temperature as well as possible other functions.

Chemical reactions are intended to occur, for example, as described in US Patent Application Publication No. 2010/0199557. The contents of the resulting syngas (including CO and $H_2$ as well as possible others) and the consumption rates of the feed bed and the C bed are influenced by the oxygen (or air) and, possibly, steam introduced through tuyeres in the various sections.

Among variations that may optionally be employed together with the disclosed innovations are outlet ports for the syngas that have intruded ducts within the reactor vessel. Also, variations on the nature of feed ports may include feed port intrusions into the reactor vessel and/or mechanisms to vary the angle or distance feed material enters from the feed ports. The mentioned published patent application may be referred to for further information of such features.

In large part, many aspects of the total gasifier design and operation may be varied in accordance with past practices in plasma gasifiers and still incorporate innovations presented herein, such as, but not limited to, the top section quench system or the arrangement of one or more feed ports in the middle section proximate the feed bed.

Plasma gasifiers with a top section quench system are different than known PG practices that sometimes involve introducing a moderating gas directly into a freeboard region of a PG for purposes of stopping, or minimizing, gasification in the freeboard region. For example, in Dighe et al. U.S. Pat. No. 7,632,394, Dec. 15, 2009, there is disclosure of steam introduction into a freeboard region to reduce the temperature to about 450° C. or less to minimize further cracking of oil fractions in the process being performed of reducing heavy hydrocarbons.

In embodiments of the present invention, particularly aimed for use in processes for converting diverse waste to syngas (although not necessarily limited to such processes), the quench fluids are introduced into a quench zone that is in addition to and on top of the freeboard region where substantially complete gasification occurs. The quench zone here is, for example, to avoid exit of soft particles of fly ash containing such things as metal oxides that have melting points of about 900° C. or more. The quench system, as disclosed here, can reduce their temperature to about 850° C. The quench system is not needed, and usually would not be wanted, to cool the gases further. Some further gasification in the quench zone can be favorable; where steam is included in the quench fluid that can be a plus as the steam can assist in cracking heavy hydrocarbons. But further gasification in the quench zone is generally not a main goal compared to that of minimizing the exiting of soft particles. A more important consideration is that the quench zone volume (additional to that of the freeboard region) accommodates all the expanding gases, from the introduced quench fluids, so the flow of syngas from the freeboard region to the outlets is smooth.

Figure 4:
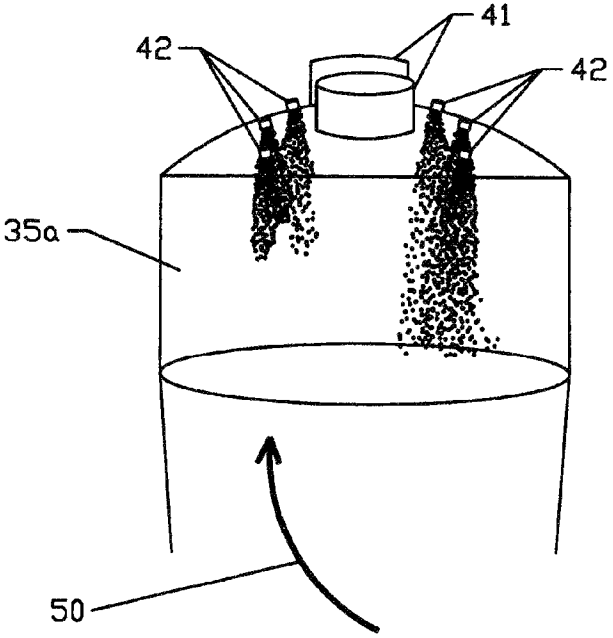
FIGS. 3 and 4 are pictorial examples of product gas and quench fluid flows in a reactor.
Figure 3:
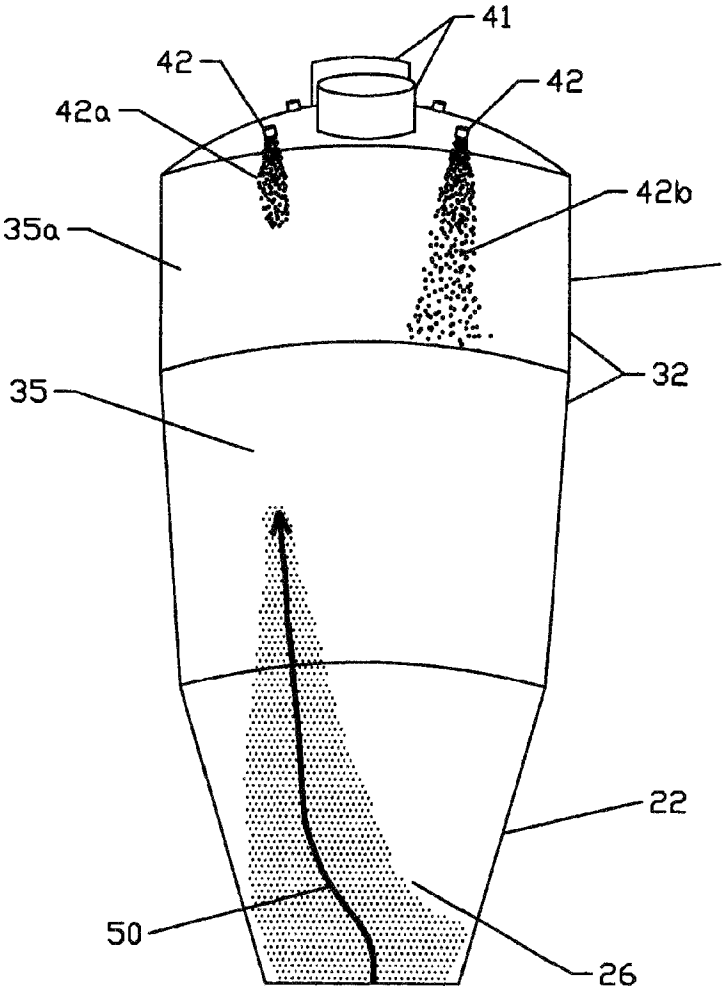

FIGS. 3 and 4 are provided for further explication of some embodiments of the quench system. These views show some part of a reactor vessel 10 (using the same reference numerals as for corresponding elements in FIGS. 1 and 2 although they are not necessarily identical) including, in FIG. 3, the middle section 22 containing a feed bed 26 (not fully delineated in this view but is one created by feed introduced through one or more feed ports, not shown, that may be like the feed ports 23 of FIG. 1 or otherwise), a top section 32 including both a freeboard region 35 directly above the middle section 22 and a quench zone 35*a* above the freeboard region 35. The quench zone 35*a* has quench fluid inlets or nozzles 42 (which can be arranged as shown in FIG. 2).

The reactor is only partially shown in FIG. 3 without the bottom section with a C bed and plasma torches, e.g., as shown and described in connection with FIG. 1. What is shown is that rising hot gases from the feed bed 26 are inherently not uniform or stable in location; hotter gases shift around similar to flames in a fireplace. The modeling of the FIG. 3 example shows how injected fluid 42*a* from a left nozzle 42 encounters a rising, very hot gas plume, represented by an arrow 50, and is more rapidly dissipated in the quench zone 35*a* than injected fluid 42*b* from a right nozzle 42 that encounters a cooler section of gas flow. As the hotter gas changes location, different ones of the array of inlets 42 are similarly affected. A fuller illustration of an array of inlets 42 is shown in FIG. 4 along with quench fluid that penetrates well into the quench zone 35*a* but may be variably dissipated depending on the gas temperatures encountered. Therefore, as seen, the range of discernible spray from the inlets 42 is not necessarily uniform. However, an array of nozzles 42 can, in some other embodiments, be equipped with a gas temperature sensing and fluid flow adjustment system so that the injected fluid can be increased in volume when hotter gas is encountered at a specific nozzle.

A few additional comments on aspects of side entry, multiple, feed ports are the following and can pertain to reactors generally even without a quench zone, although that combination would be often desirable. It is known that the porosity of a feed bed (such as 26) is normally higher along or near the side walls when feed material comes in from the top. If lateral feed ports are used, more material is deposited near the walls because of proximity to the feed ports. This results in more resistance to gas flow along the walls. Gas is also, at least sometimes, injected through the walls (e.g., by tuyeres 33 and 34). The side feed ports make it less likely for gases rising from the C bed to be channeled along the wall without reacting with feed materials because of bypassing the bed. Now, with side entry feed ports, any such tendency is minimized and more gas is forced towards the center of the vessel. Consequently, this can sometimes be an additional favorable aspect of lower side entry feed ports with feed bed buildup at the vessel walls more than in the center. So while it is generally the case that a substantially uniform feed bed mass is desirable across the middle section 22, the extent to which the feed ports 23 result in a greater build up of feed material at the wall 24 is not a severe detriment and is preferable to having a greater buildup of feed material in the center of the vessel.

The angling up of feed ports 23 in FIG. 1 is an example of an innovation that allows feed ports to be above but close to the upper surface of the feed bed 26 without feed material in a feed port being subjected to radiation heating causing blockage (e.g., by melting). Otherwise it may be desirable to provide a cooling arrangement for the feed port. It can also be useful for lateral feed ports to have a feeding mechanism (e.g., a ram type feeder, a flap value system, a lock hopper system, a discrete feeder or a screw feeder).

Regarding the quench system, in some applications, there may be processes with feed material that is high in complex hydrocarbons and concerns can arise about undesirable tar formation. However, the quench system, when water and/or steam is included in the injected fluid, will aid in conversion of any polycyclic aromatic hydrocarbons (PAHs) rising from the freeboard region into the quench zone to CO, $CO_2$, $H_2$ and $H_2O$. Multiple phase fluids (e.g., water and steam together) can work well as a quench fluid. Steam can serve as a motive gas to atomize water better than just having a water spray. Water, $H_2O$ in either form, (water, when injected, will quickly turn to steam) offers an advantage of allowing use of a smaller mass of fluid, compared to some other gas that may be cooler when injected, because of its latent heat of vaporization. Also, it may be noted that the volume of the quench zone in the reactor can be a function of the droplet size of fluid droplets injected or formed in the quench zone. Finer water droplets will evaporate more quickly and descend less distance in the vessel than larger droplets.

Quenching is often best if regulated in relation to the rate in which feed material is introduced. The system can be designed so that a lowering of the feed rate results in a lowering of the rate of quench fluid injected in order to control the gas temperature.

Reactors of interest can have any number of outlet ducts located anywhere in the roof or upper side wall. But two or more ducts can be favorable in the respect that temperature monitoring in the ducts can indicate temperature differences that can be used to adjust quench fluid flow through the respective nozzles to help make the ducts output more uniform if preferential flow is established in one duct.

Multiple feed ports, as in the example discussed, can be run at individually different rates to adjust for changes in the feed bed that may occur across the bed.

Among the potential variations of the foregoing examples that are within the broader aspects of the present inventions are embodiments in which one or more middle section feed ports are located, through the side wall below the upper surface (26*a* of FIG. 1) of the feed bed (26). That is, such extra-low feed ports (not shown in FIG. 1) are for feeding material directionally into the feed bed (26) and the feed bed is intentionally continued up past those extra-low feed ports, in contrast to the prior description.

Figures 5, 6, 7, 8:
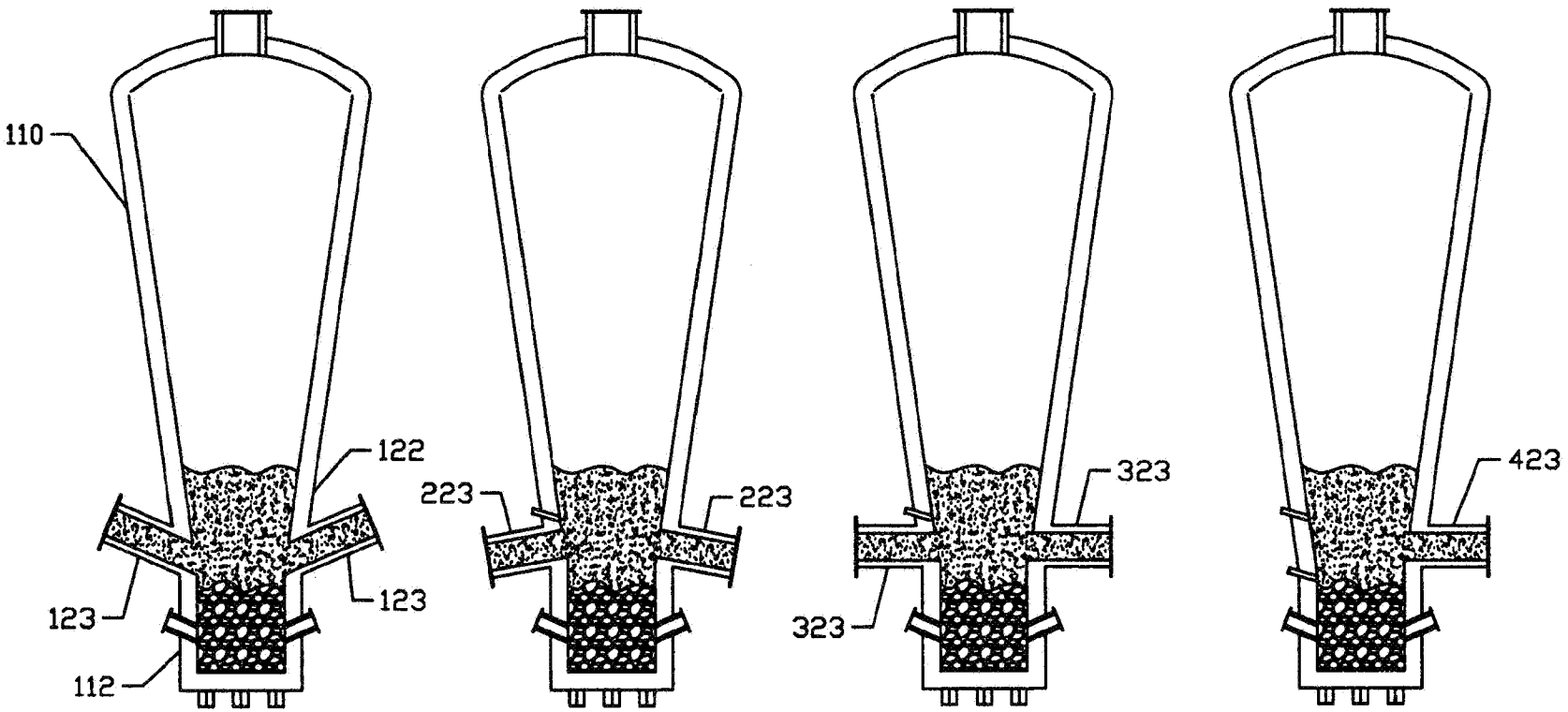
FIGS. 5-8 are examples, in elevational cross-section, of gasifiers with feed ports below the top surface of a feed bed.

FIGS. 5-8 illustrate example gasifier reactors with such extra-low feed ports (sometimes referred to as underfeeding feed ports). FIG. 5 has a reactor outline 110 similar to vessel 10 of FIG. 1. Although otherwise similar to the FIG. 1 reactor, here lateral feed ports 123 are located at such a low level in the middle section 122, proximate the C bed of the bottom section 112, that the feed bed 126 extends up above the level of the feed ports. In FIG. 5, feed ports 123 are angled down, as may allow for some gravity assist to the entry of feed material.

FIGS. 6-8 are like FIG. 5 with certain variations. In FIG. 6, feed ports 223 are angled up. In FIG. 7, feed ports 323 are horizontal and in FIG. 8 a single feed port 423 is shown with lower and upper feed bed tuyeres 427 and 428, respectively. (Such tuyeres, described in connection with FIG. 1, may be provided into a feed bed regardless of the nature, location, orientation or number of feed ports.)

Extra-low, or underfeeding, feed ports, such as those of FIGS. 5-8 are preferably provided with a feeding mechanism as previously described. In addition, it may be important in most instances for each such feed port to be provided with a cooling arrangement (e.g., coils supplied with a coolant such as water wrapped around the feed port) in order to keep feed material cool enough to move readily through the feed port.

Such extra-low feed ports may either be the only feed ports into the reactor vessel or they may be additional to one or more other feed ports, which may be like the feed ports 23 or otherwise. Equipment can be arranged with the extra-low feed ports so feed material can be effectively forced into the feed bed.

Extra-low feed ports can be provided in a reactor vessel for use as desired. An example of their use can be where the feed material contains a relatively large amount of fine particulates. By having such material submerged in the feed bed it will be entrained by rising hot gases initially in the feed bed for more thorough gasification which may occur either in the feed bed itself or above the feed bed.

An additional aspect of some suitable embodiments is to separate fines, or particulates in general, from syngas that exits through the outlets and recycle them into the reactor through any one or more feed ports or tuyeres including those that feed into the C bed or directly into the feed bed (by extra-low feed ports) or above the feed bed.

The disclosed embodiments include innovations for improved performance in enabling one or both of (1) more thorough gasification of particulate feed material and (2) minimization of the occurrence of unreacted molten particles of feed material exiting a reactor vessel along with syngas and being deposited on an inner wall of external ductwork from a vessel outlet.

While it is generally the case that PGRs can take advantage of the described features individually, there can be a preference for their use in combination. Particularly when used in combination, opportunities for greater output of syngas with good qualities from a wider variety of feed material compositions can be enhanced.

One example is to provide an arrangement of quench fluid inlets in an upper part (such as the roof) of a top section of the reactor vessel and injecting a fluid such as, but not limited to, water, steam, or a mix of water and steam, to cool soft or molten bits of unreacted feed material sufficiently to minimize the number of them exiting the reactor vessel that are likely to be deposited on the inside of external ductwork. The arrangement of quench fluid inlets (sometimes referred to herein as a quench system (or partial quench system)) is best combined with a reactor vessel having an additional volume (referred as a quench zone) that allows for the volume of expanding fluids from the quench fluid inlets so as to minimize any adverse effects on flow of syngas from a freeboard region below the quench zone to syngas outlets. In prior practices, the ductwork from syngas outlets has often been subject to a build up of deposited material and a quench system with good performance inside a duct is difficult to build.

Another technique, an embodiment of which (without a quench system) is also disclosed in the aforementioned companion patent application, is to provide a reactor vessel with a bottom section, for containing a carbonaceous bed, a middle section, for containing a bed of deposited feed material, and a top section including a freeboard region and a roof over the freeboard region and having one or more feed ports through the lateral wall of the middle section, above and proximate to the upper surface of the bed of feed material or into the bed itself. This enables the feed material to be (a) for heavier segments, deposited quickly and directly on the feed bed for reaction and (b) for lighter particles (or "floaters") that are kept above the feed bed by rising hot gases, to have a long residence time within the vessel that promotes more complete reaction (gasification) of the particles. Feed ports into the bed itself, sometimes referred to as underfeeding, can substantially prevent floaters. The companion application also explains how such an arrangement can contribute to less carbon usage in the carbonaceous bed of the bottom section. This arrangement contrasts from some prior practices of PGRs with one or more feed ports located only in a top section well above the feed bed. Here, embodiments are included that make the distance between feed ports and gas outlets large by the location of feed ports no higher than only a short distance above the feed bed while the gas outlets in the top section are remote from the feed bed.

Merely by way of example, the referred to sections of the reactor vessel, particularly the middle and top sections, may include truncated inverse conical shapes, wider at their upper ends, which contribute to achievement of substantially constant gas velocity for the increasing quantity of gas rising within the vessel. (See the above-mentioned published patent application as to such conical configurations.) The top section conical wall may have less of an angle to the center axis of the reactor vessel than the middle section conical wall; and the top section has an additional upper volume, referred to as the quench zone, where quench fluid inlets are effective, that is, in one illustrative example, within a cylindrical part above the conical part of the top section.

Specific, but not the only, embodiments may combine, in a reactor vessel having the above-mentioned conical characteristics, a bottom section (which may be cylindrical) with a carbonaceous bed (of coke or as presented in the companion application) and plasma nozzles, a middle section (conical) with a plurality (e.g., two or three) of lateral feed ports to feed process material onto or just above the carbonaceous bed with good distribution over the interior of the middle section, a top section above the middle section that has both a freeboard region (with a conical configuration that may be less angular than the middle section) and, above the freeboard region, a quench zone (that may have a cylindrical configuration) in which injected fluid at least partially quenches (i.e., hardens or makes less soft) solid bits of matter rising with gaseous reaction products from below to one or more outlet ports at or near the top of the quench zone.

Multiple syngas outlets are better than a single, central, gas outlet in the respect that the outlets away from the roof center cause gas flow toward the lateral walls of the vessel and prevent funneling or core flow being established, resulting in better use of the reactor volume.

What is claimed is:

1. A process for gasification of solid feed material to produce a syngas comprising:

providing a plasma heated carbonaceous bed in a bottom section of a reactor vessel;

feeding feed material into the reactor vessel to form a bed of deposited feed material on top of the carbonaceous bed in the bottom section;

reacting the feed material with hot gases rising from the bottom section;

forming, in a middle section of the reactor vessel, a syngas mixture containing a varying quantity of unreacted particles of the feed material;

allowing the syngas mixture to rise into a top section of the reactor vessel including a conical part toward one or more syngas outlets in a roof of the reactor vessel;

maintaining conditions in the vessel such that unreacted particles from the middle section are subjected to further reactions in a first, lower, part of the top section; and at least partially quenching, by injecting a quench fluid including water, steam, or a mixture thereof, through a plurality of quench fluid inlets in the roof into a quench zone in a second, upper part of the top section, at least some of the unreacted particles sufficiently to reduce the number of unreacted particles exiting the reactor vessel that are likely to be deposited on walls of external ductwork, wherein the quench zone is located in a cylindrical part between the conical part of the top section and the roof.

2. The process of claim 1, wherein:

the quenching step reduces the temperature of the unreacted particles by about 150° C. to 300° C. before the unreacted particles reach one or more outlets of the reactor vessel.

3. The process of claim 1, wherein:

the quenching step reduces the temperature of the syngas mixture that enters the top section at about 1000° C. to 1150° C. down to about 850° C.

4. The process of claim 1, wherein:

at least some of the unreacted particles are made sufficiently solid such that the unreacted particles are not subject to stick to walls of the external ductwork.

5. The process of claim 1, wherein:

steam included in the quench fluid assists in cracking heavy hydrocarbons in the syngas mixture.

6. The process of claim 1, wherein:

the quench fluid is injected downwardly through a plurality of nozzles in a roof of the reactor vessel.

7. The process of claim 6, wherein:

the nozzles are positioned adjacent to the syngas outlet.

8. The process of claim 7, wherein:

the nozzles are positioned symmetrically around the outlet in the reactor vessel.

9. The process of claim 1, wherein:

the quench fluid is injected through a plurality of nozzles and flows of the quench fluid through the nozzles is not uniform.

10. The process of claim 1, further comprising:

a gas temperature sensing and fluid flow adjustment system configured to increase the volume of the injected quench fluid when hotter gas is encountered near at least one of the nozzles.

11. The process of claim 1, wherein:

the quench fluid aids in conversion of any polycyclic aromatic hydrocarbons (PAHs) rising from the freeboard region into the quench zone to CO, $CO_2$, $H_2$ and/or $H_2O$.

12. The process of claim 1, wherein:

the steam serves as a motive gas to atomize water in the quench fluid.

13. The process of claim 1, wherein:

the size of the quench zone in the reactor is a function of a droplet size of the quench fluid injected into, or formed in, the quench zone.

14. The process of claim 1, wherein:

a rate of quench fluid injection is regulated in relation to a rate in which the feed material is introduced.

15. The process of claim 1, further comprising:

monitoring temperature in two or more output ducts and adjusting quench fluid flow through nozzles to make syngas flow through the ducts more uniform.

16. The process of claim 1, wherein:

the step of feeding feed material into the reactor vessel includes supplying feed material from one or more external feed sources through one or more feed ports in a wall of the middle section of the reactor vessel, said feed ports being located no higher than above, and proximate to, an upper surface of the bed of deposited feed material; and the step of maintaining conditions in the vessel such that unreacted particles from the middle section are subjected to further reactions in a first, lower, part of the top section are performed in a manner to enhance reactivity of particulate matter within the feed material by proximity to the feed bed and prolonging residence time of the unreacted particles, promoting additional reactions thereof, before the syngas mixture reaches an outlet in the reactor vessel.

17. The process of claim 16, wherein:

the feeding of feed material is performed in a substantially continuous and uniform manner.

18. The process of claim 16, wherein:

the feeding of feed material includes use of one or more feed ports located immediately above the bed of deposited feed material and angled upwardly to avoid excess heating by the bed reactions of feed material in the feed ports.

19. The process of claim 16, wherein:

the feeding of feed material includes using one or more feed ports configured to feed material directly into the bed of deposited feed material with substantial reaction of the feed material from the feed ports within the bed itself.

20. The process of claim 1, further comprising:

replacing reacted carbonaceous material in the bottom section with additional carbonaceous material supplied through the one or more feed ports of a wall of the middle section.

21. A process for gasification of solid feed material to produce a syngas in a reactor vessel including a bottom section, a top section, and a middle section between the bottom section and the top section, the method comprising:

providing a plasma heated carbonaceous bed in the bottom section of a reactor vessel;

feeding feed material into the reactor vessel to form a bed of deposited feed material on top of the carbonaceous bed in the bottom section;

reacting the feed material with hot gases rising from the bottom section;

forming, in the middle section of the reactor vessel, a syngas mixture containing a varying quantity of unreacted particles of the feed material, wherein the middle section is configured as a truncated inverse cone that is wider adjacent the top section than adjacent the bottom section and configured to contain the bed of deposited feed material;

allowing the syngas mixture to rise into the top section of the reactor vessel toward one or more syngas outlets in a roof of the reactor vessel, wherein the top section includes a conical part starting adjacent the middle section that has an overall configuration of a truncated cone that is wider at a higher end of the conical part than adjacent the middle section, the top section including a freeboard region in a lower part of the top section and a quench zone in an upper part of the top section, and wherein the middle section truncated inverse cone has a larger wall angle relative to a center line of the vessel than the wall angle of the conical part of the top section;

maintaining conditions in the vessel such that unreacted particles from the middle section are subjected to further reactions in the lower part of the top section; and at least partially quenching, by injecting a quench fluid including water, steam, or a mixture thereof, through a plurality of quench fluid inlets in the roof into a quench zone in the upper part of the top section, at least some of the unreacted particles sufficiently to reduce the number of unreacted particles exiting the reactor vessel that are likely to be deposited on walls of external ductwork.

* * * * *